US006773473B2

(12) United States Patent
Kinisky et al.

(10) Patent No.: US 6,773,473 B2
(45) Date of Patent: Aug. 10, 2004

(54) SUPERCRITICAL FLUID EXTRACTION

(75) Inventors: Thomas G. Kinisky, Chagrin Falls, OH (US); Jodi Ann Vecchiarelli, Feeding Hills, MA (US); David A. Sheldon, Millbury, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 10/291,976

(22) Filed: Nov. 12, 2002

(65) Prior Publication Data

US 2004/0088926 A1 May 13, 2004

(51) Int. Cl.[7] ..... B24D 3/34; B24D 3/18

(52) U.S. Cl. ..... 51/296; 51/293; 51/298; 51/307; 51/308; 51/309

(58) Field of Search ..... 51/296, 298, 293, 51/307, 308, 309

(56) References Cited

U.S. PATENT DOCUMENTS

| | | | | | |
|---|---|---|---|---|---|
| 2,806,772 | A | * | 9/1957 | Robie | 51/296 |
| 5,094,672 | A | * | 3/1992 | Giles et al. | 51/309 |
| 5,221,294 | A | | 6/1993 | Carman et al. | |
| 5,429,648 | A | | 7/1995 | Wu | |
| 5,536,282 | A | * | 7/1996 | Yoon et al. | 51/293 |
| 5,738,697 | A | * | 4/1998 | Wu et al. | 51/296 |
| 6,086,648 | A | * | 7/2000 | Rossetti et al. | 51/304 |
| 6,361,403 | B1 | * | 3/2002 | Kuramochi et al. | 451/41 |
| 6,375,543 | B1 | * | 4/2002 | Kuramochi et al. | 451/28 |

FOREIGN PATENT DOCUMENTS

| | | |
|---|---|---|
| JP | 3161273 | 7/1991 |
| JP | 3281174 | 12/1991 |

OTHER PUBLICATIONS

J.F. Baumard, T. Chartier, M. Ferrato, P. Pourtalet; Extraction De Liants Organiques Par Fluides Supercritiques Pour La Realisation De Pieces Ceramiques; pp. 71–76, (no date).

Christos Boukouvalas, Kostis Magoulas, and Dimitrios Tassios; Application of Supercritical Fluid Extraction in Industrial Waste Treatment: Thermodynamic Modeling and Design; Separation Science and Technology, 33(3), pp. 387–410, 1998, (no month).

H. Schmieder, N. Dahmen, J. Schon and G. Wiegand; Industrial and Environmental Applications of Supercritical Fluids; Chemistry Under Extreme or Non–Classical Condiitons, pp. 273–316, (no date).

* cited by examiner

*Primary Examiner*—Michael Marcheschi
(74) *Attorney, Agent, or Firm*—Mary E. Porter; Sampson & Associates

(57) ABSTRACT

A method is provided for fabricating an abrasive article having porosity. The method includes blending a mixture of abrasive grain, bond material, and pore inducer, in which the pore inducer is soluble in a supercritical fluid, and the abrasive grain and bond material are substantially insoluble in the supercritical fluid. The mixture is pressed into an abrasive laden composite and exposed to the supercritical fluid for a period of time suitable to dissolve at least a portion of the pore inducer. The composite is thermally processed.

40 Claims, 6 Drawing Sheets

SUPERCRITICAL FLUID EXTRACTION

BACKGROUND OF THE INVENTION (1) Field of the Invention

The present invention relates generally to abrasives and abrasive tools suitable for surface grinding and polishing of hard and/or brittle materials. This invention more particularly relates to porous, bonded abrasive articles having an interconnected pore structure and methods for making same.

(2) Background Information

The use of porous abrasive products to improve mechanical grinding processes is well known. Many high performance abrasive products require a controlled amount of porosity, and interconnected porosity, to be engineered in to the structure of vitrified and resin bonded grinding wheels. Pores typically provide access to grinding fluids, such as coolants and lubricants, which promote efficient cutting, minimize metallurgical damage (e.g., surface burn), and maximize tool life. Pores also permit the clearance of material (e.g., chips or swarf) removed from an object being ground, which is important especially when the object being ground is relatively soft or when surface finish requirements are demanding.

Previous techniques used to fabricate vitrified bonded abrasive articles and/or tools having porosity have involved creating a pore structure by the addition of organic pore inducing media into the abrasive article. A number of pore inducing materials have been used historically. Examples include PDB/Naphthalene, walnut shells, com, peach pits, and carbon balls. These media sublime or thermally decompose upon firing, leaving voids or pores in the cured abrasive tool. Examples of abrasive tools fabricated in this manner are disclosed in U.S. Pat. No. 5,221,294 to Carmen, et al., and U.S. Pat. No. 5,429,648 to Wu, and Japan Patents A-91-161273 to Grotoh, et al., A-91-281174 to Satoh, et al.

There are, however, drawbacks associated with using these pore inducers. Relatively long, slow burnout cycles are generally required to volatilize and remove the pore inducers from vitrified bonded wheels. Moreover, the volatilized materials are often environmentally hazardous. This off-gassing procedure also tends to be a significant cause of rejections in manufacturing, as it often leads to structural changes and cracking in the fired wheels.

Other examples of porous abrasive tools are disclosed in U.S. patent application Ser. No. 09/990,647 (the '647 application), entitled Porous Abrasive Tool and Method For Making the Same, filed Nov. 21, 2001, which is fully incorporated herein by reference.

As market demand has grown for precision components in products such as engines, bearings, and electronic devices (e.g., silicon and silicon carbide wafers, magnetic heads, and display windows) the need has grown for abrasive tools for fine precision grinding of a range of relatively hard and/or brittle materials and soft, heat-sensitive materials. Similarly, the need has grown for environmentally friendly techniques for fabricating such tools. Therefore, there exists a need for an improved method of fabricating porous abrasive articles and tools, and for the abrasive articles and abrasive tools produced thereby.

SUMMARY OF THE INVENTION

One aspect of the present invention includes a method for fabricating an abrasive article having pores. The method includes blending a mixture of abrasive grain, bond material, and pore inducer, and pressing said mixture into an abrasive laden composite. The composite is exposed to a supercritical fluid for a period of time suitable to dissolve at least a portion of the pore inducer. The pore inducer is soluble in the supercritical fluid, and the abrasive grain and bond material are substantially insoluble in the supercritical fluid. The composite is then thermally processed.

Another aspect of the present invention includes a method for fabricating an abrasive article having from about 40 to about 85 volume percent porosity. The method includes blending a mixture of abrasive grain, non-metallic bond material, and pore inducer, said mixture including from about 30 to about 48 volume percent abrasive grain, from about 4 to about 20 volume percent bond material, and from about 1 to about 36 volume percent pore inducers. The mixture is pressed into an abrasive laden composite, and exposed to a supercritical fluid for a period of time suitable to dissolve at least a portion of said pore inducer. The abrasive grain and bond material are substantially insoluble in the supercritical fluid. The composite is then thermally processed.

DETAILED DESCRIPTION

The present invention includes a method for producing porous abrasive articles that may be useful in precision grinding, polishing, or cutting applications. One aspect of the present invention was the realization that fluids such as carbon dioxide, when raised to a temperature and pressure beyond their critical point (i.e., supercritical fluids), have desirable solvent and flow (diffusivity) properties that may be useful for infiltrating abrasive tools during their manufacture. Although supercritical fluids had been used in a variety of industrial applications, such as for the decaffeination of coffee, they had not been used to infiltrate solid matrix composites such as grinding wheels for the purpose of generating porosity therein.

Advantageously, when used in the context of the present invention, such supercritical fluids have been found to exhibit liquid-like properties, such as the ability to dissolve other materials, while also exhibiting flow properties (e.g., diffusivity) similar to that of a gas, that enable them to effectively infiltrate the structure of green (unfired) grinding tools. The present invention thus involves the use of a supercritical fluid to infiltrate and extract or "dissolve" pore inducers, such as wax, from unfired, molded grinding wheels. For example, vitrified grinding wheels of fixed geometry may be fabricated with pore inducers that are soluble in supercritical fluids such as carbon dioxide. While the wheel is in its green state (prior to firing), supercritical carbon dioxide may be used to infiltrate, dissolve and remove the pore inducers, nominally without adversely affecting the structural integrity of the wheel. Thereafter, the wheel may be fired in a conventional manner.

Since a useful medium for this Supercritical Fluid Extraction (SFE) is carbon dioxide, the approach disclosed herein is environmentally friendly, particularly when the $CO_2$ is captured for reuse. Other potential advantages of the present invention include a relatively large range of pore inducer candidate materials (discussed hereinbelow), and the ability to control pore size and distribution to create new structures. For example, varying the amount and size distribution of pore inducer granules in a given product will affect pore size and distribution and also may affect bond phase distribution which in turn can affect mechanical properties and grinding performance behavior of the abrasive tool. Thus, the present invention advantageously facilitates fabrication of a wide range of abrasive tools while reducing or eliminating the fugitive emission of hazardous materials generated by conventional pore-inducer bum-out techniques. The invention also tends to reduce the cracking failures often generated by the relatively long firing cycles used to effect such bum-out of organic pore inducers from vitrified bonded tools.

Figure 1:
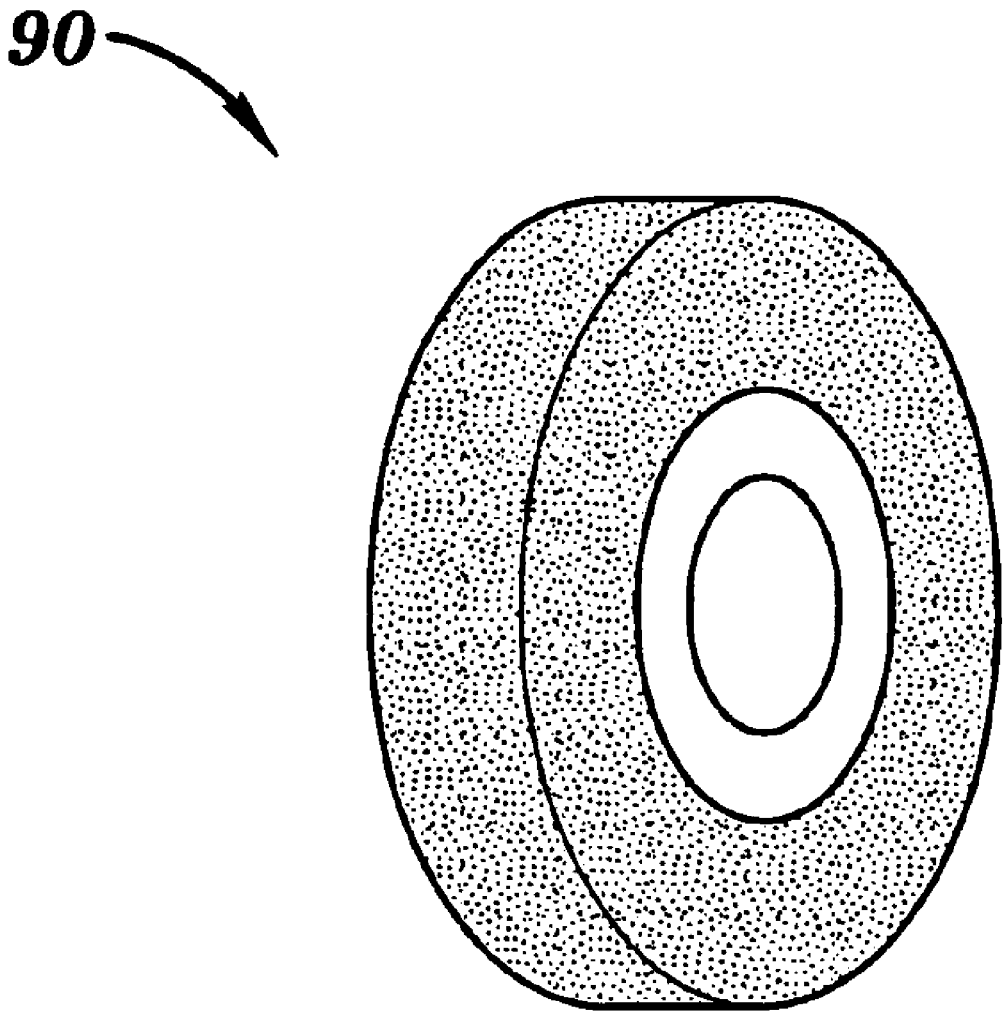
FIG. 1 is a schematic representation an exemplary abrasive tool, in the form a grinding wheel, fabricated using the method of this invention.

One example of an abrasive grinding tool fabricated in accordance with the present invention is bonded abrasive wheel 90 of FIG. 1, which is further described in Examples 2 and 3 hereinbelow. As shown, wheel 90 is configured as a conventional ANSI Type 1 wheel. However, the present invention may be used in conjunction with substantially any sized and shaped grinding tool, including wheels of ANSI Types 1, 2, 5–7, 11–13, 16–18, 18R, 19–27, 27A, 28, etc., including segmented wheels as discussed hereinbelow. Particular embodiments utilize inorganic bond material. However, it is contemplated that organic, metallic, or resinous bond material (together with appropriate curing agents if necessary) may be used without departing from the spirit and scope of the present invention. Other embodiments may include abrasive segments to form a segmented grinding wheel as described in further detail hereinbelow) and discs, stones and hones used for abrasive polishing and grinding.

Embodiments of this invention include fabricating abrasive articles having from about 45 to about 70 volume percent interconnected porosity. Particular embodiments include fabricating abrasive articles with a non-metallic bond, such as a vitrified (glass) or organic bond material (e.g., phenolic resin), with from about 45 to about 70 volume percent interconnected porosity. Grinding wheels (e.g., grinding wheel 90) fabricated according to this invention are potentially advantageous for mirror finish grinding of hard and/or brittle materials, such as silicon wafers, silicon carbide, alumina titanium carbide, and the like.

Substantially any abrasive grain may be used in the abrasive articles of this invention. Conventional abrasives may include, but are not limited to, alumina in fused, sintered, and/or sol gel, silica, silicon carbide, zirconia-alumina, fused or sintered alloys of alumina with at least one ceramic oxide selected from the group consisting of $M_gO$, $C_oO$, $TiO_2$, $V_2O_3$ $Cr_2O_3$, ceria, boron suboxide, garnet, and emery in grit sizes ranging from about 0.5 to about 5000 microns, preferably from about 2 to about 1200 microns. Superabrasive grains, including but not limited to diamond and cubic boron nitride (CBN), with or without a metal coating, having substantially similar grit sizes as the conventional grains, may also be used. Abrasive grain size and type selection typically vary depending on the nature of the workpiece and the type of grinding process. For fine finish (i.e., 'mirror finish') grinding, superabrasive grains having a smaller particle size, such as ranging from about 0.5 to about 300 microns or even from about 0.5 to about 150 microns may be desirable. In general, smaller (i.e., finer) grain sizes are preferred for fine grinding and surface finishing/polishing operations, while larger (i.e., coarser) grain sizes are preferred for shaping, thinning, and other operations in which a relatively large amount of material removal is required.

Substantially any type of bond material commonly used in the fabrication of bonded abrasive articles may be used as a matrix material in the abrasive article of this invention, provided the binder used in the bond is substantially insoluble to the supercritical fluid being used to remove the pore inducer. As mentioned above, a vitrified bond is used in many desirable embodiments.

An example of an organic bond that may be used in some embodiments, is a thermosetting resin, but other types of resins may be used. The resin may be either an epoxy resin or a phenolic resin, and it may be used in liquid or powder form. Specific examples of thermosetting resins include phenolic resins (e.g., novolak and resole), epoxy, unsaturated polyester, bismaleimide, polyimide, cyanate ester, melamines, and the like.

The above-described interconnected porosity is formed during fabrication by adding a sufficient quantity of pore inducers to the abrasive grain and bond mixture to insure that a relatively high percentage of pore inducers are in contact with other pore inducers in the molded abrasive article. Embodiments having 45 to 70 volume percent interconnected porosity generally have average pore sizes ranging from about 50 to about 2000 microns, which pores are formed by utilizing pore inducers of about the same size range.

Although a pore inducer particle size in the range from about 50 to about 2000 microns may be used, a range of about 75 to about 1750 microns may be desired in many applications. In one desirable embodiment the pore inducers include a particle size distribution from about 75 to about 210 microns (i.e., including pore inducers finer than U.S. Mesh (Standard Sieve) 70 and coarser than U.S. Mesh 200). In another desirable embodiment, the pore inducers include a particle size distribution from about 210 to about 300 microns (i.e., including pore inducers finer than U.S. Mesh 50 and coarser than U.S. Mesh 70). In yet another desirable embodiment, pore inducers having particle size distributions ranging from about 150 to about 500 microns may be used (i.e. including pore inducers finer than U.S. Mesh 35 and coarser than U.S. Mesh 100).

For polishing tools, pore inducer particle sizes may be smaller, on the order of 1–50 microns. In general, selection of a fine abrasive grain will dictate selection of a roughly equivalent pore inducer particle size.

Particular desirable embodiments exhibit from about 45 to about 66 volume percent interconnected porosity with average pore sizes ranging from about 75 to about 1750 microns. These embodiments further include from about 30 to about 48 volume percent abrasive and from about 4 to about 15 volume percent vitrified (glass) bond.

Substantially any pore inducer that may be readily dissolved in a supercritical fluid such as carbon dioxide, may be used. In general, suitable pore inducers are non-polar materials, including non-polar organic materials such as: alkanes with molecular structures greater than n-octadecane (C18H38), e.g., those having up to about 40 Carbon atoms, to include the paraffin wax family; cycloalkanes, e.g., cyclic paraffins and non-polar derivatives that have melting points in excess of about 60 degrees C; arenes (e.g., aromatic hydrocarbons), including biphenyl (C12H10) and larger molecular structures and non-polar derivatives; butyl carbamate; and mixtures thereof.

In particular embodiments, the pore inducer is selected from the group consisting of: alkanes; C16–C40 alkanes and their non-polar derivatives; C10 or greater cycloalkanes and their non-polar derivatives; C10 or greater alkenes and their non-polar derivatives; C10 or greater arenes and their non-polar derivatives; lipids; hydrocarbons; waxes; and mixtures thereof.

In preferred embodiments, the pore inducer includes at least one of: biphenyl; butyl carbamate; and wax. Preferred supercritical fluids useful for removing these pore inducers include $CO_2$, ethane, propane, butane, $H_2O$, and combination thereof.

The abrasive articles of the present invention may be fabricated using many aspects of conventional abrasive product fabrication processes. Abrasive, bond, and pore inducer powders of suitable size and composition are well mixed, and molded (e.g., compressed at pressures up to about 5000 psi) into a suitable shape. After molding and drying, the abrasive laden composites, including pore inducers that are substantially in contact with one another, are immersed or otherwise exposed to a supercritical fluid in order to selectively remove (i.e., dissolve) the pore inducers. (As used herein, the term 'exposed' includes immersing the abrasive article in supercritical fluid, passing supercritical fluid through the article, or any other approach that brings the supercritical fluid into contact with the pore inducer.) The composite is then fired (typically at temperatures ranging from about 800 to about 1300° C. when using vitrified bond) to yield a composite of a desired (i.e., target) density. The resultant abrasive article preferably has a density of at least 95% of the theoretical specification (target) density, and is generally within a range of from about 98 to 102% of the theoretical specification density. The resultant article includes a mixture of abrasive and bond matrix, and has a network of nominally randomly distributed interconnected pores from which the pore inducer has been dissolved.

The abrasive articles described hereinabove may be used to fabricate substantially any type of grinding tool. Generally desirable tools include the ANSI Types mentioned hereinabove. In addition, segmented grinding wheels, such as described in the above-referenced '647 application may be provided. Examples of such abrasive articles include abrasive grain composites such as bonded abrasive wheels, discs, blades, stones, hones, coated abrasive articles, abrasive grain agglomerates, and combinations thereof. Briefly described, a segmented wheel, such as an ANSI Type 2A2TS wheel, includes a core having a central bore for mounting the wheel on a grinding machine, the core being configured to support a porous abrasive rim disposed along its periphery (as discussed in more detail hereinbelow with respect to Example 1). These two portions of the wheel are typically held together with an adhesive bond that is thermally stable under grinding conditions, and the wheel and its components are designed to tolerate stresses generated at wheel peripheral speeds of up to at least 80 m/sec, and desirably up to 160 m/sec or more.

The core is substantially circular in shape, and may comprise substantially any material having a minimum specific strength of about 2.4 MPa-$cm^3$/g and a density of, about 2.0 to about 8.0 g/$cm^3$. Examples of suitable materials are steel, aluminum, titanium, bronze, their composites and alloys, and combinations thereof. Reinforced plastics having the designated minimum specific strength may also be used to construct the core. Composites and reinforced core materials typically include a continuous phase of a metal or a plastic matrix, often initially provided in powder form, to which fibers or grains or particles of harder, more resilient, and/or less dense, material is added as a discontinuous phase. Examples of reinforcing materials suitable for use in the core of the tools of this invention are glass fiber, carbon fiber, aramid fiber, ceramic fiber, ceramic particles and grains, and hollow filler materials such as glass, mullite, alumina, and Z-Light spheres. Generally desirable metallic core materials include ANSI 4140 steel and aluminum alloys, 2024, 6065 and 7178.

A segmented wheel (not shown) may be fabricated in an otherwise conventional manner by forming individual segments (e.g., "chucking" segments) having a preselected dimension, composition and porosity, by mixing grain, bond and pore inducing materials, molding/pressing, exposure to a supercritical fluid for pore inducer extraction, and thermal processing (firing) as described hereinabove.

The segments are then typically finished by conventional techniques, such as by grinding or cutting using vitrified grinding wheels or carbide cutting wheels, to yield an abrasive segment having the desired dimensions and tolerances. For example, in the embodiment shown, segments have an arcuate profile having a predetermined radius of curvature. The segments may be attached to the periphery of the core with a suitable adhesive, such as epoxy resin.

The abrasive articles and tools of this invention (e.g., grinding wheel 90 shown in FIG. 1) and others discussed herein are desirable for grinding metals and ceramic materials including various oxides, carbides, nitrides and, silicides such as silicon nitride, silicon dioxide, and silicon oxynitride, stabilized zirconia, aluminum oxide (e.g., sapphire), boron carbide, boron nitride, titanium diboride, and aluminum nitride, and composites of these ceramics, as well as, e.g., steel, aluminum, Inconel alloy, titanium, cast iron and other metal alloys and certain metal matrix composites, such as cemented carbides, and polycrystalline diamond and polycrystalline cubic boron nitride.

The modifications to the various aspects of the present invention described hereinabove are merely exemplary. It is understood that other modifications to the illustrative embodiments will readily occur to persons with ordinary skill in the art. All such modifications and variations are deemed to be within the scope and spirit of the present invention as defined by the accompanying claims.

The following examples merely illustrate various embodiments of the articles and methods of this invention. The scope of this invention is not to be considered as limited by the specific embodiments described therein, but rather as defined by the claims that follow. Unless otherwise indicated, all parts and percentages in the examples are by weight.

EXAMPLE 1

Several sample pellets of vitrified grinding wheel material were fabricated using approximately 7.67 weight percent of wax as a pore inducer. The pellets were fabricated as follows:

| Basic Formulation: | |
|---|---|
| 30.8 wt % | Glass Powdered Frit Bond* |
| 7.6 wt % | Wax Filler (pore inducer)* |
| 10.8 wt % | SiC (Silicon carbide) abrasive* |
| 50.9 wt % | CBN (Cubic Boron Nitride abrasive* |
| 100% | |

*Compositions were as follows:
SIC abrasive grain: −400 mesh (obtained from Saint-Gobain Ceramics & Plastics, Inc., Worcester, MA.

-continued

| Basic Formulation: |
|---|
| CBN: As Supplied by General Electric Superabrasives, Worthington, Ohio, as BZN-1 Size B16 (120/140 US sieve mesh size)<br>Glass Powdered Frit Bond Composition: Glass Formers (SiO2, B2O3, Al2O3, V2O5) = 87.0% Alkali/Alkaline-earth Oxides (Na2O, MgO, CaO) = 9.1% Fillers and Impurities (TiO2, Fe2O3, $B_4C$) = 3.9%<br>Wax Filler: A natural hydrocarbon wax with a micro paraffin structure (supplied by Th. C. Tromm, as Polarwachs 30410, Koln, Germany) was pressed into spheres of either 63–90 or 90–125 microns in size to yield a pore inducer material containing a 50/50 wt % blend of 63/90 $\mu$m size wax spheres and 90/125 $\mu$m wax spheres. |

These four materials were dry mixed in a 140 gram total mix sample in a sealed container mounted on a paint mixing machine. A binder solution (11.3 wt % of the dry mix weight) containing 26.7 wt % PEG 12,000 (PEG=Poly Ethylene Glycol with a molecular weight of 12,000 Purchased from Firma Hoechst in Frankfort-am-Main, Germany) with 73.3 wt % De-ionized Water was blended with the dry mix to form a uniform sticky wet mix.

The mix was agglomerated by forcing the blended product through a 1.25 mm stainless steel screen using a steel spatula and hand pressure. The resulting granules (~1.25 mm in size) were dried by placing them into a drying oven at (~40° C.) for ~16 hours. After drying, all granule samples were pressed at 22KN/cm$^2$ into pellets of ~20 mm in outer diameter by ~5 mm in thickness.

While in their green state, supercritical carbon dioxide was used to extract the wax from three samples, respectively using three different extraction procedures. The extraction procedures were as follows:

| Supercritical Fluid Extraction | | | |
|---|---|---|---|
| Extractor: | Hewlett Packard (HP) Model 7680T SFE | | |
| Extraction Fluid: | SFE/SFC grade $CO_2$ | | |
| Thimble size: | 7.0 ml | | |
| Sample size: | about 0.5 gram | | |
| Trap packing: | Octadecylsilica | | |
| Rinse solvent: | Cyclohexane and/or acetone | | |
| SFE procedure | 1 | 2 | 3 |
| 1st step | | | |
| Mode | Static | Static | Static |
| Extraction temp. (° C.) | 50 | 50 | 50 |
| Extraction time (min) | 30 | 45 | 30 |
| $CO_2$ flow rate (mL/min) | 2 | 2 | 2 |
| Density (g/mL) | 0.91 | 0.91 | 0.91 |
| 2nd step | | | |
| Mode | Static/ dynamic* | Static/ dynamic* | Static/ dynamic* |
| Extraction temp. (° C.) | 60 | 60 | 70 |
| Extraction time (min) | 5/45 | 10/60 | 10/45 |
| $CO_2$ flow rate (mL/min) | 2 | 2 | 2 |
| Density (g/mL) | 0.88 | 0.88 | 0.84 |

| GC/MS | | |
|---|---|---|
| Gas chromatography: | HP 5890 series II | |
| Detector: | HP 5971 MSD | |
| Carrier gas; | Helium | |
| Temperature prog: | Initial temp.: | 45° C. for 4 min |
| | Heating rate: | 10° C./min |
| | Final temp.: | 220° C. for 65 min |
| Pressure: | 12 psi (82.7 mPa) | |
| Column: | SPB-35 | |

-continued

| Supercritical Fluid Extraction |
|---|
| *Static Extraction (sample is immersed in extraction fluid) followed by Dynamic Extraction ($CO_2$ fluid flows through the sample at 2 ml/min). |

All of the samples were weighed before and after extraction. An unextracted sample was analyzed by thermal desorption Gas Chromatography/Mass Spectrometry (GC/MS), to determine a representative chemical content thereof. The material removed from the three extracted samples was analyzed using GC/MS and Fourier Transform Infrared Spectroscopy (FTIR).

Results show the average weight loss of the extracted samples was approximately 7.78 percent, which was nominally identical to the weight percent of the wax. Moreover, while the analysis of the unextracted sample revealed a composition of alkanes (wax), and a binder (bis92-hydroxy4-methoxyphenly)-methanone, the analysis of the extract revealed only alkanes. All of the pellets maintained their structural integrity. These test results indicate that the SFE process successfully extracted the pore inducer, advantageously without extracting the organic binder of the bond material.

EXAMPLE 2

Porous abrasive wheels (identified below as 133 and 139) according to the principles of this invention were prepared in the form of Type 1 bonded alumina wheels (FIG. 1, 90) utilizing the materials and processes described below, including biphenyl (180 to 250 micron granule size) as a pore inducer.

Wheel Recipe & Mixing:

| Material | Weight % | Mixing Sequence - Hobart Mixer (bench) |
|---|---|---|
| 60 grit (300 micron) white fused alumina | 76.20** | 1. placed in mix pan |
| −60/+80 mesh biphenyl | 7.23 | 2. placed in mix pan |
| Stadex 124 corn dextrin | 0.76 | Added to abrasive + biphenyl and dry blended |
| Star Liquid Glue 900 | 2.77 | 3. weighed and pre-blended together added to the dry ingredients |
| Ethylene glycol | 0.26 | |
| 100% frit$^{\Phi}$bond A | 12.02* | 4. added slowly to the mix |
| Stradex 124 corn dextrin | 0.76 | 5. added last |

*10.3 vol. %
**48 vol. %
15 vol. %
$^{\Phi}$glass powder prepared by melting and cooling
"A": glass bond material described in U.S. Pat. No. 5,536,283 (Example 1).

Mix was screened and placed in a plastic bag.

Wheel Pressing:

Wheel Size=1.5×0.5×0.5" (3.8×1.3×1.3 cm)

Green Density=2.214 g/cm$^3$ (28.5 grams per wheel)

Pore-inducer extraction via supercritical fluid ($CO_2$) was conducted on wheels 133 and 139 using a 300 cc stainless steel autoclave (Autoclave Engineers, Inc.) equipped with a pressure gauge and Magnedrive II mixing device. Temperature, pressure, and supercritical fluid flow rates for each wheel were as follows:

| Wheel No. | Temp. | Pressure | $CO_2$ Flow Rate |
|---|---|---|---|
| 133 | 50° | 3000 psi | 140 g/hr |
| 139 | 70° | 3000 psi | 140 g/hr |

Wheel Firing:

The wheels were fired in an electric laboratory kiln to 950° C. for 4 hours.

An otherwise identical Control wheel (biphenyl Std) was fabricated using conventional thermal extraction (i.e., burnout) of the pore inducer (i.e., the biphenyl was removed by thermal decomposition during the firing process).

Two more otherwise identical Control wheels (SHL-2 Std and SHL-3 Std) were fabricated using 7 vol % (4.5 weight %) Walnut shells instead of biphenyl as the pore inducer. The walnut shell pore inducers were thermally extracted during the firing process.

Testing

All of the wheels were tested by grinding inner cylindrical surfaces of workpieces fabricated from hardened 52100 steel to create bores having inner diameters of 2 inches (5cm). The wheels were tested at two removal rates (Q'). After dressing the wheels, five 0.20 inch grinds off the part diameter were made. Power was recorded for each grind. Wheel and part measurements (i.e., metal removal, wheel wear, surface finish, and waviness) were made after the final grind. Peak power was plotted as a function of cumulative metal removal based on the total feed, feed rate, and grind time.

Test Results

Figure 2:
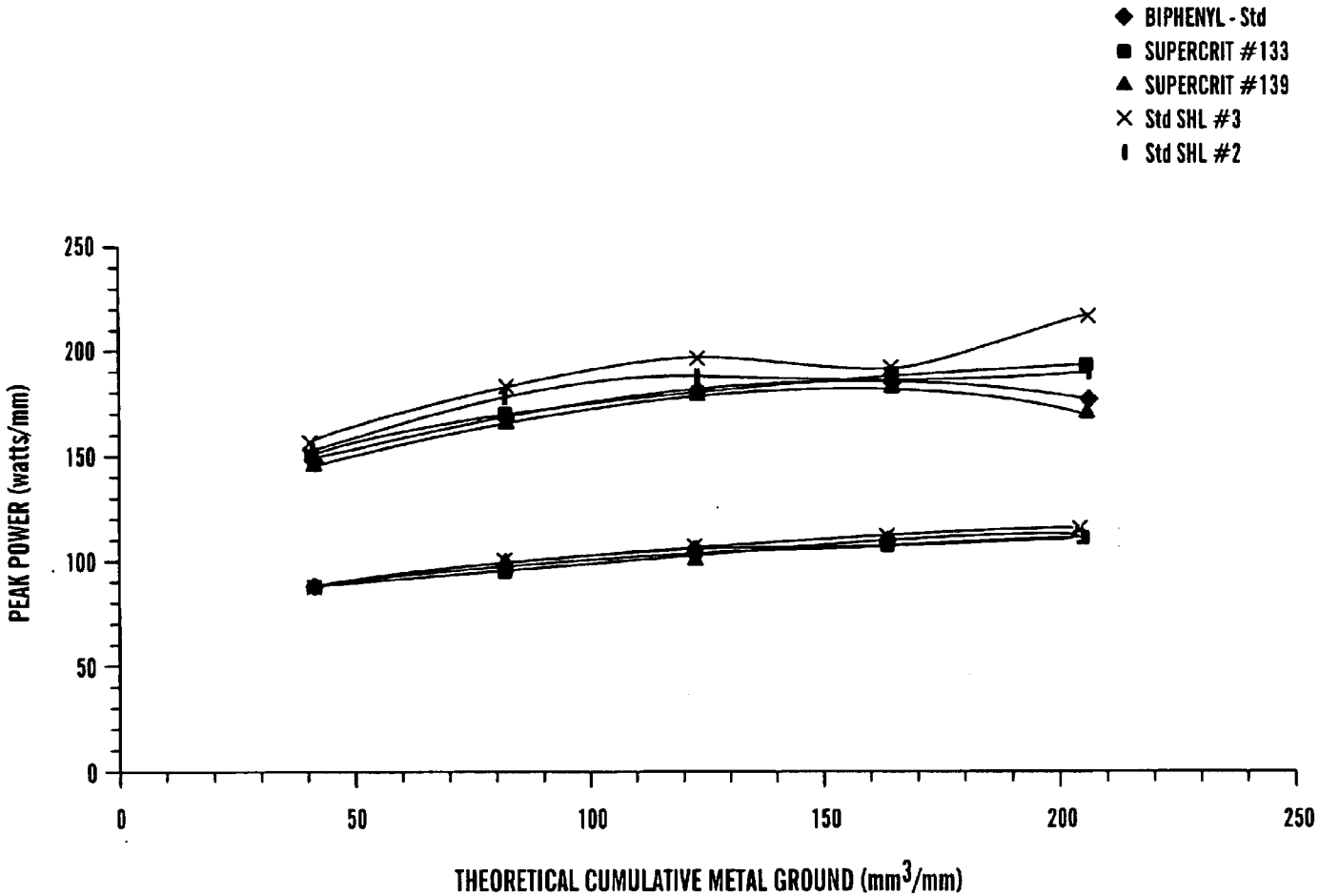
FIGS. 2–6 are graphical representations of test results comparing performance of various exemplary grinding wheels fabricated according to the present invention, with that of various control wheels.
Figure 3:
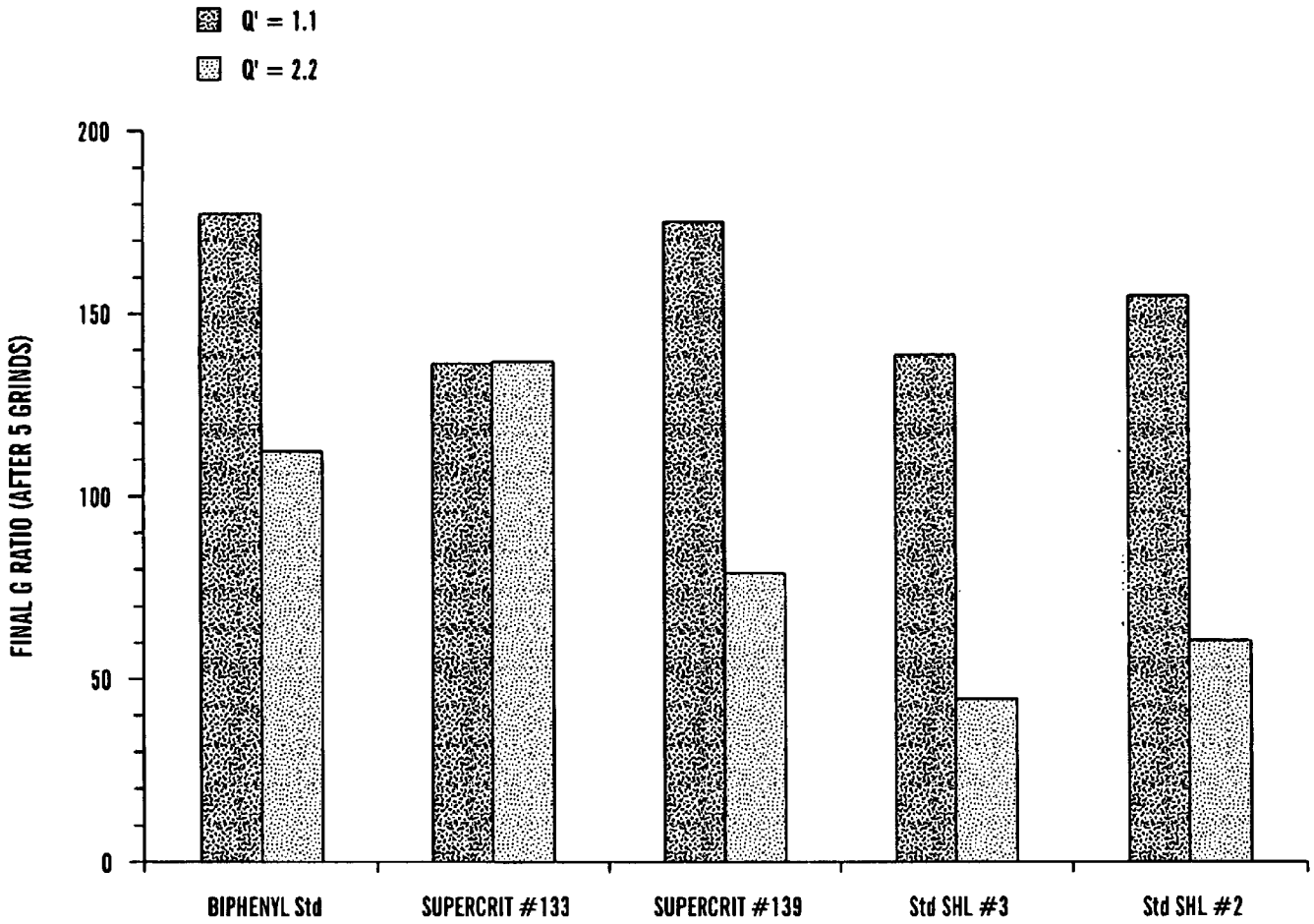

Results of the testing described above are shown in FIGS. 2 & 3. As shown in FIG. 2, the wheels containing biphenyl (biphenyl Std, 133, and 139) performed similarly to slightly better than the SHL-2 and SHL-3 standard wheels. The biphenyl wheels had nominally equivalent behavior at the lower Q', and advantageously, had slightly lower and more consistent power usage at the higher Q'. Referring to FIG. 3, the biphenyl wheels exhibited similar to slightly better cumulative G ratios (i.e., cumulative ratio of volume of material ground to volume of wheel consumed) than the SHL-2 and SHL-3 standard wheels at the lower Q', and better G ratios at the higher Q'. The biphenyl wheels produced final surface finishes that were comparable to those of the standard wheels.

SUMMARY

Supercritical fluid extraction of an organic pore inducer (biphenyl) and subsequent conventional firing of the resulting porous wheel composition resulted in better grinding efficiency (G-ratio) performance than the conventional commercial product (SHL-2, SHL-3). The thermally extracted biphenyl wheel (Biphenyl Std) performed similarly to the extracted wheels. This is not unexpected since biphenyl sublimes and was thus removed from the wheel structure during the very early stages of firing without damaging the green wheel structure. Supercritical fluid extraction, however, advantageously, reduces environmental emissions by extracting the pore inducer prior to firing, where it may be captured for re-use.

Conversely, while not wishing to be tied to any particular theory, it is believed that during firing of the SHL-2 and SHL-3 wheels, the Walnut shells swell as they bum, disrupting the green microstructure by breaking some of the bonds thereof. This disruption then generates shrinkage as the bond begins to melt and flow, since the disrupted bonds provide relatively little resistance to such movement.

EXAMPLE 3

Porous abrasive wheels (identified below as TD-2-29 and TD-2-45) according to the principles of this invention were prepared in the form of Type 1 bonded alumina abrasive wheels (FIG. 1, 90), utilizing butyl carbamate (180 to 250 micron granule size) as a pore inducer. These wheels were fabricated substantially and set forth in Example 2, with the following changes:

- 80 grit (245 micron) alumina abrasive grain was used to achieve a fired (i.e., final) composition of 40 vol % (86.4 weight %) abrasive grain
- Frit bond A at 10.3 vol % (13.6weight % ) was used.
- 15 vol % (8 weight %) (in unfired wheel) butyl carbamate was used
- wheel size was 2×0.6×0.5 inches (5.1×1.5×1.3 cm)
- Supercritical fluid extraction was conducted at 50° C., 3000 psi, and $CO_2$ Flow Rate of 140 grams/hour
- The butyl carbamate pore inducer was nominally fully extracted upon total flow of less than 300 g $CO_2$ through the wheels. This is shown in Table I below, which indicates that the concentration of butyl carbamate in the extractant fell rapidly after passing 100 to 150 grams of $CO_2$ through the wheels, and reached negligible levels after passing about 250 grams through the wheels.

TABLE I

| Grams $CO_2$ Passed through wheel | 0 | 50 | 100 | 150 | 200 | 250 | 300 |
|---|---|---|---|---|---|---|---|
| Concentration of butyl carbamate ($g/gCO_2$) | 0 | 0.07 | 0.06 | 0.02 | 0.01 | 0.006 | <.006 |

An otherwise identical Control wheel (Butyl Carb. Burnout) was fabricated using conventional thermal extraction (i.e., burnout) of the pore inducer.

Another otherwise identical Control wheel (Standard w/SHL) was fabricated using 7 vol % (4.5 weight %) walnut shells as the pore inducer. The walnut shell pore inducers were thermally extracted during the firing process.

Testing

All of the wheels were tested by grinding inner cylindrical surfaces of workpieces fabricated from hardened 52100 steel to create bores having inner diameters of 2.5 inches (6.4cm). The wheels were tested at three removal rates (Q'). After dressing the wheels, five 0.20 inch grinds off part diameter were made. Power, metal removal, and wheel wear were recorded for each grind. Surface finish and waviness were measured after the final grind at each removal rate.

Test Results

Figure 4:
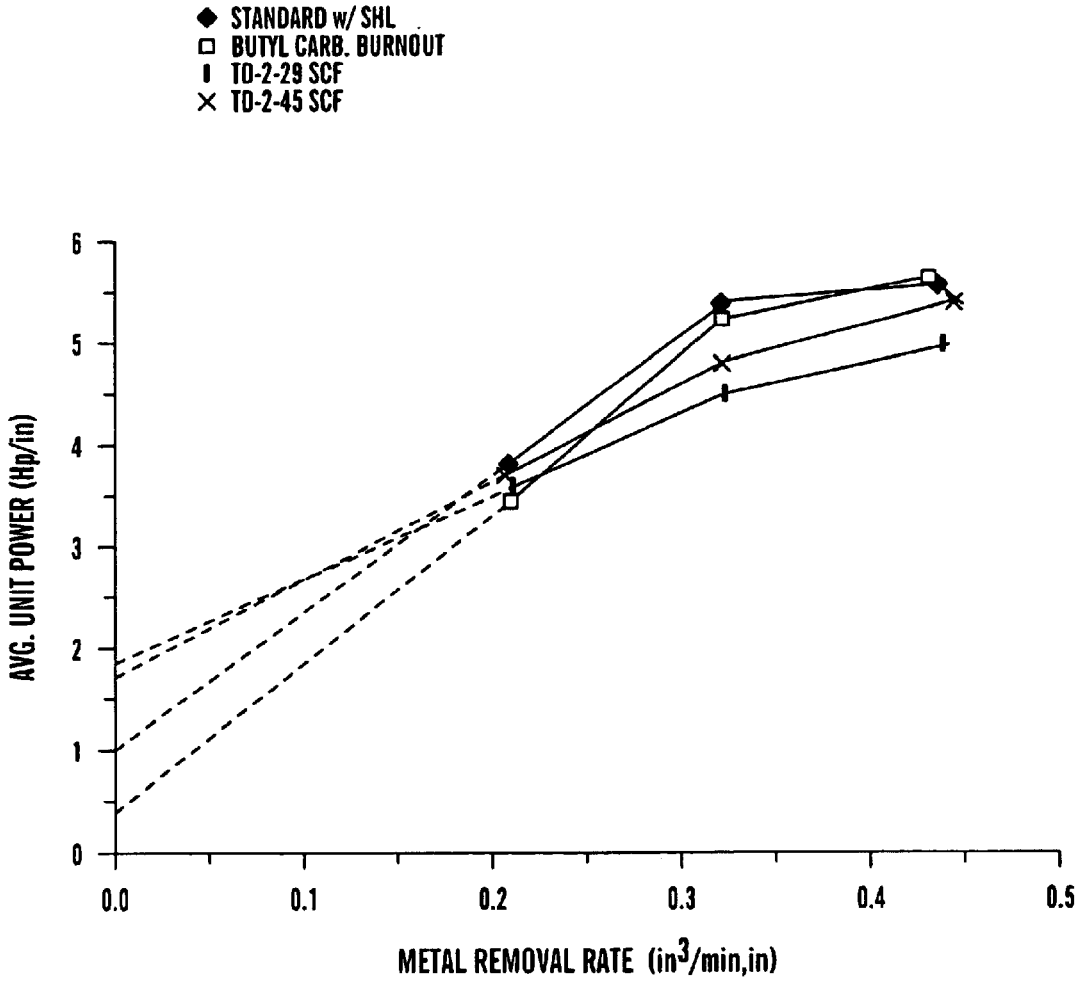

Results of the testing described above are shown in FIGS. 4–6. As shown in FIG. 4, the wheels containing butyl carbamate (Butyl Carb Burnout, TD-2-29 SCF, and TD-2-45 SCF) performed similarly to the Standard SHL wheel, with the two TD wheels of the invention performing similarly, to slightly better than the standard SHL wheel.

Figure 5:
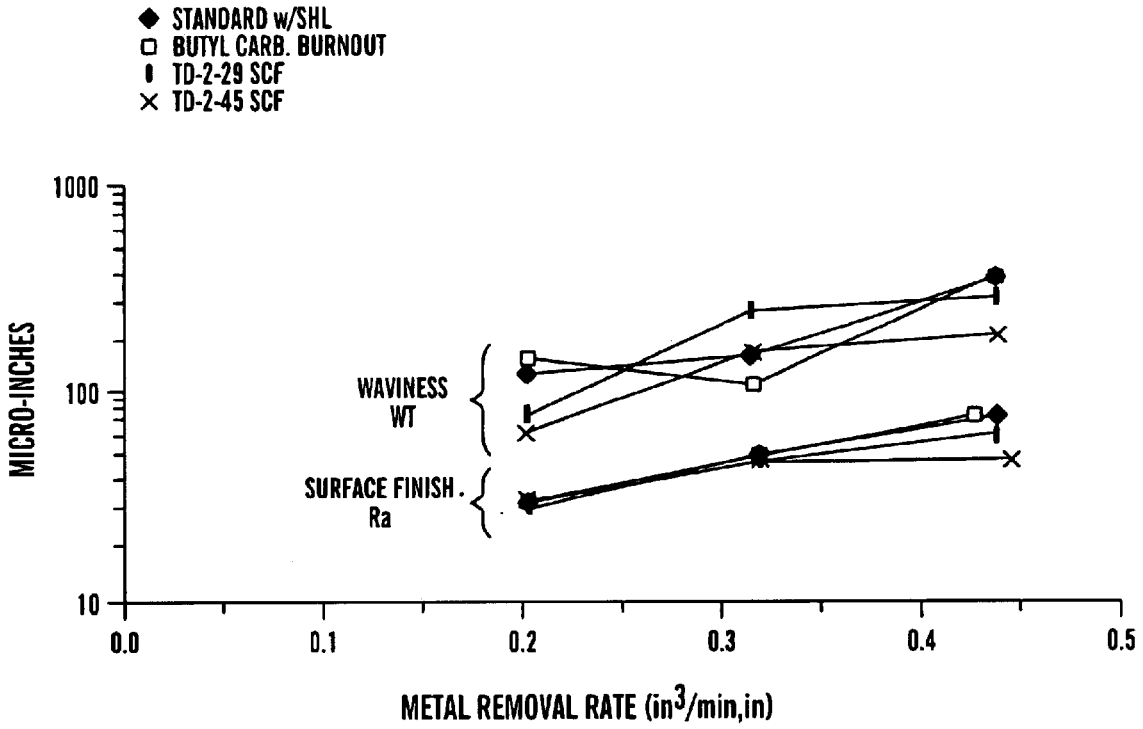
Figure 6:
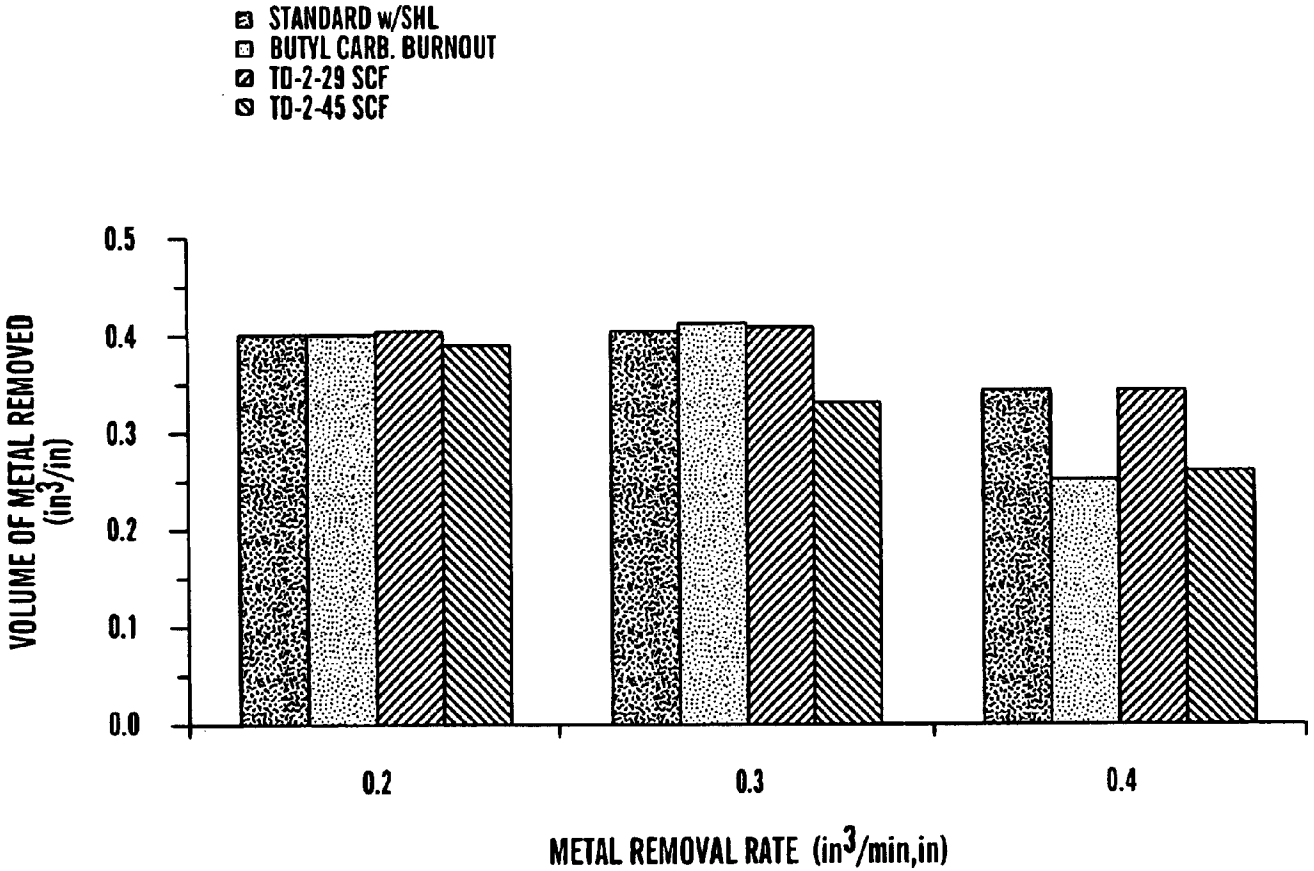

The TD wheels of the invention exhibited slightly lower G ratios than the Standard SHL wheel, but produced similar final surface finishes and waviness values to those of the Standard SHL as shown in FIG. 5. This negates the slightly lower G ratio since part quality would dictate the dressing frequency. As shown in FIG. 6, the cumulative metal removal rates of the TD wheels were similar to those of the other wheels tested.

SUMMARY

Supercritical fluid extraction of an organic pore inducer (butyl carbamate) and subsequent conventional firing of the resulting porous wheel composition resulted in similar performance to that of the conventional commercial product (Standard w/SHL wheel). The thermally extracted butyl carbamate wheel (Butyl Carb Burnout) performed similarly to the SCF extracted wheels of the invention. Supercritical fluid extraction, however, advantageously, reduces environmental emissions by extracting the pore inducer prior to firing, where it may be captured for re-use.

The difference in behavior of the two TD wheels may have been related to slight differences in the SCF extraction process. However, the behavioral difference is considered small and is generally within expected limits based on conventional manufacturing tolerances.

What is claimed is:

1. A method for fabricating an abrasive article having pores, said method comprising:

a) blending a mixture of abrasive grain, bond material, and pore inducer;

b) pressing said mixture into an abrasive laden composite;

c) exposing said composite into a supercritical fluid for a period of time suitable to dissolve at least a portion of said pore inducer, said pore inducer being soluble in said supercritical fluid; and d) thermally processing the composite;

wherein said abrasive grain and said bond material are substantially insoluble in said supercritical fluid.

2. The method of claim 1 wherein said thermally processing (d) is performed in a temperature range of:

greater than or equal to about 150° C.; and less than or equal to about 1300° C.

3. The method of claim 1 wherein said pressing b) is performed in a pressure range of:

greater than or equal to about 10 psi (6.9 megaPascal); and less than or equal to about 5000 psi (34,575 megaPascal).

4. The method of claim 1 wherein the pore inducer in said abrasive laden composite ranges from:

greater than or equal to about 1 volume percent; and less than or equal to about 36 volume percent.

5. The method of claim 1 wherein said pore inducer has a particle size ranging from:

greater than or equal to about 50 microns; and less than or equal to about 2000 microns.

6. The method of claim 5 wherein said pore inducer has a particle size ranging from:

greater than or equal to about 75 microns; and less than or equal to about 1750 microns.

7. The method of claim 4 wherein the pore inducer in said abrasive laden composite ranges from:

greater than or equal to about 2 volume percent; and less than or equal to about 32 volume percent.

8. The method of claim 7, wherein the pore inducer in said abrasive laden composite ranges from:

greater than or equal to about 2 volume percent; and less than or equal to about 30 volume percent.

9. The method of claim 1, wherein the abrasive grain in said mixture ranges from:

greater than or equal to about 30 volume percent; and less than or equal to about 48 volume percent.

10. The method of claim 1, wherein the bond in said mixture ranges from:

greater than or equal to about 4 volume percent; and less than or equal to about 20 volume percent.

11. The method of claim 10 wherein said bond material is non-metallic.

12. The method of claim 11 wherein said non-metallic bond material comprises a vitrified bond.

13. The method of claim 11 wherein said bond material comprises an organic bond material.

14. The method of claim 13 wherein the organic bond material comprises a resin selected from the group consisting of phenolic resins, epoxy resins, unsaturated polyester resins, bismaleimide resins, polyimide resins, cyanate resins, melamine polymers, and mixtures thereof.

15. The method of claim 14 wherein said organic bond material comprises a phenolic resin.

16. The method of claim 1 wherein said abrasive grain comprises an abrasive grain selected from the group consisting of diamond, cubic boron nitride, fused alumina, sintered alumina, sintered sol gel alumina, alumina-zirconia, alumina-oxynitrides, silicon carbide, fused or sintered alloys of alumina with at least one ceramic oxide selected from the group consisting of $M_gO$, $C_oO$, $TiO_2$, $V_2O_3$ $Cr_2O_3$, and combinations thereof.

17. The method of claim 1 wherein said abrasive grain has an average particle size ranging from:

greater than or equal to about 0.5 microns; and less than or equal to about 5000 microns.

18. The method of claim 17 wherein said abrasive grain has an average particle size ranging from:

greater than or equal to about 50 microns; and less than or equal to about 1200 microns.

19. The method of claim 17 wherein said abrasive grain comprises an average particle size ranging from:

greater than or equal to about 2 microns; and less than or equal to about 300 microns.

20. The method of claim 1 wherein said pore inducer comprises a non-polar organic material.

21. The method of claim 1 wherein said pore inducer is selected from the group consisting of: alkanes; C16–C40 alkanes and their non-polar derivatives; C10 or greater cycloalkanes and their non-polar derivatives, C10 or greater alkenes and their non-polar derivatives, C10 or greater arenes and their non-polar derivatives, lipids, hydrocarbons, waxes, and mixtures thereof.

22. The method of claim 1 wherein said pore inducer comprises biphenyl.

23. The method of claim 1 wherein said pore inducer comprises butyl carbamate.

24. The method of claim 1 wherein said pore inducer comprises wax.

25. The method of claim 1 wherein said pore inducer comprises cyclic paraffin.

26. The method of claim 21 wherein said pore inducer has a particle size distribution ranging from:

greater than or equal to about 75 microns; and less than or equal to about 210 microns.

27. The method of claim 21 wherein said pore inducer has a particle size distribution ranging from:

greater than or equal to about 210 microns; and less than or equal to about 300 microns.

28. The method of claim 21 wherein said pore inducer has a particle size distribution ranging from:

greater than or equal to about 150 microns; and less than or equal to about 500 microns.

29. The method of claim 21 wherein said pore inducer has a particle size distribution ranging from:

greater than or equal to 500 microns; and less than 2000 microns.

30. The method of claim 1 wherein said supercritical fluid is selected from the group consisting of $CO_2$, ethane, propane, butane, $H_2O$, and combination thereof.

31. The method of claim 1 wherein said supercritical fluid comprises carbon dioxide.

32. The method of claim 1, wherein said exposing (c) comprises immersing said abrasive article in the supercritical fluid.

33. The method of claim 1, wherein said exposing (c) comprises passing the supercritical fluid through said abrasive article.

34. An abrasive article having from about 40 to about 85 volume percent porosity, said abrasive article fabricated by the method of:

a) blending a mixture of abrasive grain, non-metallic bond material, and pore inducer, said mixture including from 30 to about 48 volume percent abrasive grain, from about 4 to about 20 volume percent bond material, and from about 1 to about 36 volume percent pore inducers;

b) pressing said mixture into an abrasive laden composite;

c) exposing said composite into a supercritical fluid (SCF) for a period of time suitable to dissolve at least a portion of said pore inducer, said pore inducer being soluble in said supercritical fluid, and said abrasive grain and said bond material being substantially insoluble in said supercritical fluid; and d) after said exposing (c), thermally processing the composite;

wherein a pressed abrasive-laden article is formed, having a structure of abrasive grain, bond material, and SCF-induced pores.

35. The abrasive article of claim 34, comprising an abrasive grain composite selected from the group consisting of bonded abrasive wheels, discs, blades, stones, hones, coated abrasive articles, abrasive grain agglomerates, and combinations thereof.

36. The abrasive article of claim 34, wherein the abrasive article has pore sizes ranging from:

greater than or equal to about 50 microns; and less than or equal to about 2000 microns.

37. The abrasive article of claim 36 wherein the abrasive article has pore sizes ranging from:

greater than or equal to about 75 microns; and less than or equal to about 1750 microns.

38. A method for fabricating an abrasive article having from about 40 to about 85 volume percent porosity, said method comprising:

a) blending a mixture of abrasive grain, non-metallic bond material, and pore inducer, said mixture including from about 30 to about 48 volume percent abrasive grain, from about 4 to about 20 volume percent bond material, and from about 1 to about 36 volume percent pore inducers;

b) pressing said mixture into an abrasive laden composite;

c) exposing said composite into a supercritical fluid for a period of time suitable to dissolve at least a portion of said pore inducer, said pore inducer being soluble in said supercritical fluid; and d) thermally processing the composite; and wherein said abrasive grain and said bond material are substantially insoluble in said supercritical fluid.

39. The method of claim 38 wherein said pressing (b) comprises pressing at pressures ranging from about 10 to about 5000 psi (6.9 to about 34,575 megaPascals).

40. The method of claim 38 wherein said thermal processing (d) is performed after said exposing (c) and comprises baking at a temperature ranging from about 150 to about 1300° C.

* * * * *